United States Patent [19]

Hartman

[11] Patent Number: 4,781,004

[45] Date of Patent: Nov. 1, 1988

[54] JOINT SYSTEM FOR ROOFING PANELS

[75] Inventor: Richard E. Hartman, Akron, Ohio

[73] Assignee: The BF Goodrich Company, Akron, Ohio

[21] Appl. No.: 425,840

[22] Filed: Sep. 28, 1982

[51] Int. Cl.[4] ..... E04D 1/36

[52] U.S. Cl. ..... 52/464; 52/403; 52/465; 52/573

[58] Field of Search ..... 52/403, 465, 573, 417, 52/419, 459, 464, 460, 461, 462, 463, 477, 573

[56] References Cited

U.S. PATENT DOCUMENTS

| | | | |
|---|---|---|---|
| 2,974,078 | 3/1961 | Petritz et al. | 52/465 |
| 3,204,377 | 9/1965 | Johnson | 52/417 |
| 3,234,692 | 2/1966 | Bierlich | 52/477 |
| 3,300,913 | 1/1967 | Patry et al. | 52/403 |
| 3,355,846 | 12/1967 | Tillson | 52/403 |
| 3,410,037 | 11/1968 | Empson et al. | 52/403 |
| 3,439,406 | 4/1969 | Wallin | 52/403 |
| 3,603,055 | 9/1971 | Dale | 52/403 |
| 3,643,388 | 2/1972 | Parr et al. | 52/403 |
| 3,969,861 | 7/1976 | O'Hanlon | 52/417 |
| 4,058,947 | 11/1977 | Earle et al. | 52/573 |
| 4,063,395 | 12/1977 | Stewart et al. | 52/417 |
| 4,067,155 | 1/1978 | Ruff et al. | 52/573 |

FOREIGN PATENT DOCUMENTS

| | | | |
|---|---|---|---|
| 644250 | 7/1962 | Canada | 52/147 |
| 2404712 | 6/1979 | France | 52/417 |
| 699355 | 11/1953 | United Kingdom | 52/750 |

*Primary Examiner*—John E. Murtagh
*Assistant Examiner*—Andrew Joseph Rudy
*Attorney, Agent, or Firm*—James R. Lindsay; Frederick K. Lacher

[57] ABSTRACT

Two side-by-side roofing panels (12,14) are connected by a reinforced connecting sheet member (40) extending between the panels (12,14) and fastened to the outside surfaces of the panels (12,14). A bead (56,58) of flowable material is positioned between the connecting sheet member (40) and the outside surface of at least one of the panels (12,14) in a space adjacent the respective side (18,20) so that upon movement of the panels (12,14) apart the connecting sheet member (40) will be straightened out and the flowable material of the bead (56,58) will be displaced into the gap (22) between the sides (18,20) of the panels (12,14).

9 Claims, 2 Drawing Sheets

JOINT SYSTEM FOR ROOFING PANELS

BACKGROUND OF THE INVENTION

This invention relates generally to joint systems for connecting roofing panels and especially for laminated panels of foam polymeric material. Difficulty has been encountered with joints between roofing panels because of the movement of one panel relative to the next after installation. This can be caused by expansion and contraction of the panels or by seasonal changes in the deck or supporting members on which the panels are mounted. In order to be economically feasible, joint systems for roofing must be relatively simple to install and be durable enough to last for a number of years.

SUMMARY OF THE INVENTION

The present invention is directed to a joint system for roofing panels in which side-by-side roofing panels are connected by a reinforced connecting sheet member fastened to the outside surfaces of the panels and bridging the gap between the panels. The connecting sheet member is held in a curved configuration by a bead of flowable material positioned between the connecting sheet member and the outside surface of at least one of the panels in a space adjacent the side of the panel. Then upon movement of the panels apart or relative to each other, the connecting sheet member will be straightened out and the flowable material of the bead displaced into the gap between the sides of the panels. The beads may be canted to provide the curved configuration of the connecting sheet member. At the edges of the sheet member, a solvent weld sealant is provided to cover the reinforcement in the sheet member and to adhere the sheet member to the panel outside surface. Where the panel has a protective membrane at the outside surface adhered to a layer of insulating foam, the connecting sheet member is adhered to the membrane. If the movement of the panels is such that the gap between panels is greater than that which can be accommodated by straightening out of the connecting sheet member, then the membrane will be pulled away from the foam layer panel surface creating new expansion joint areas without causing a break in the joint system. The present invention is also directed to a special panel construction in which a protective membrane selvedge is left on the side of the panel and this selvedge acts as the connecting sheet member overlapping a bead on an adjacent panel and being fastened by a solvent weld sealant to the outside surface of the adjacent panel.

DETAILED DESCRIPTION

Figure 1:
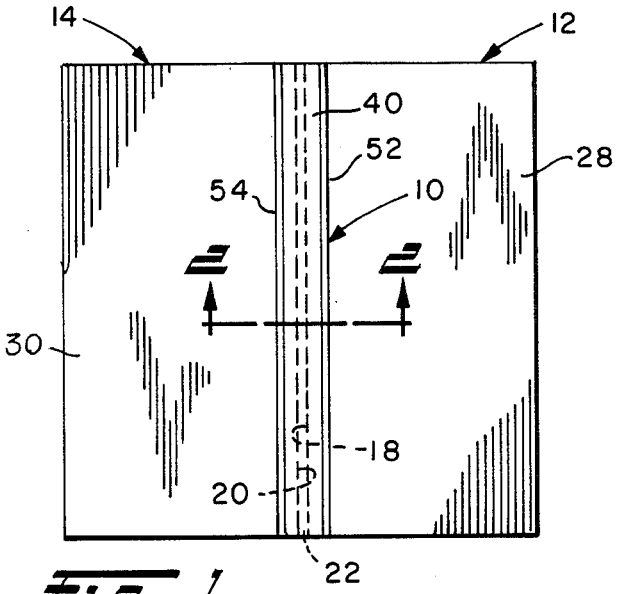
FIG. 1 is a plan view of two roofing panels in side-by-side relationship connected by a joint system embodying the invention.
Figure 2:
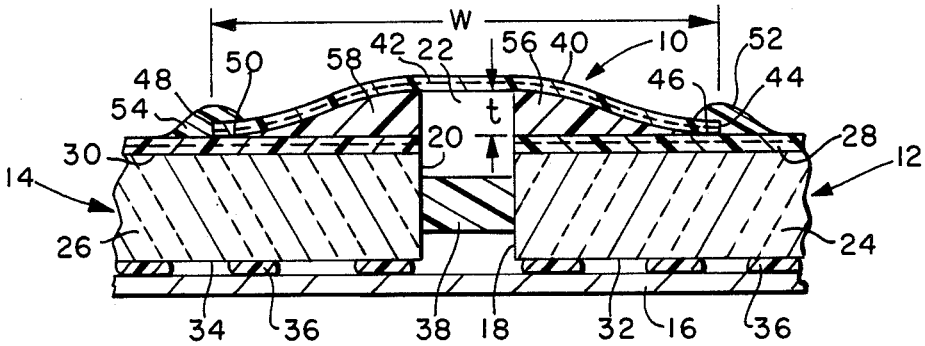
FIG. 2 is an enlarged fragmentary sectional view taken along the line 2—2 in FIG. 1 further illustrating the system as installed.

Referring to FIGS. 1 and 2, a joint system 10 is shown connecting a first panel 12 and a second panel 14 as installed on a roof deck 16. The first panel 12 has a first side 18 spaced from a second side 20 of the second panel 14 to define a gap 22 between the panels.

The first and second panels 12 and 14 may have rigid foam layers 24 and 26 of a synthetic, organic, polymeric material to produce a low density, lightweight, low-heat transmission, substantially rigid foam. The foam layers 24 and 26 are adhered to and covered at outside surfaces of the panels 12 and 14 by protective membranes 28 and 30, respectively. The protective membranes 28 and 30 are preferably of a flexible, elastic, weather-resistant material and in the embodiment shown, the membranes are of chlorosulfonated polyethylene having a mineral reinforcement. An insulative panel such as that described in my copending patent application Ser. No. 425,841 filed concurrently with this application may be used with the joint system of this invention.

As shown in FIG. 1, inside surfaces 32 and 34 of the panels 12 and 14 may be attached to the deck 16 by the application of hot asphalt or solvent-based asphaltic cements 36 between the deck and inside surfaces of the panels. A vapor barrier 38 may also be positioned in the gap 22 and adhered to the sides 18 and 20 of the panels 12 and 14. The vapor barrier 38 may be of a nonporous, elastic rubberlike material of a type well known to those skilled in the art.

The joint system 10 has a connecting sheet member 40 of suitable elastomeric material such as polyethylene reinforced by a ply 42 of suitable material such as a mineral reinforcement. As is readily apparent from the Figures, the connecting sheet 40 is characterized by a thickness of substantially lesser dimension than length and width, and two obverse, substantially parallel surfaces, free of significant or substantial integral projections. The sheet member 40 terminates at a first edge 44 which is positioned at a first position 46 on the outside surface of the first panel 12 at a spaced-apart position from the first side 18. The connecting sheet member 40 also terminates at a second edge 48 which is positioned at a second position 50 on the outside surface of the second panel 14 spaced from the second side 20. The first edge 44 and second edge 48 of the sheet member 40 are covered and adhered to the protective membranes 28 and 30 by a first solvent weld sealant 52 and a second solvent weld sealant 54.

In the space between the first side 18 and first position 46, a first bead 56 of flowable material such as hot-melt roof sealant is disposed which may be canted with a zero thickness at the first position and a predetermined thickness at the first side. In the embodiment shown, the width W of the joint system 10 is $2\frac{1}{2}$ inches. The thickness T of the bead 56 at the first side 18 is $\frac{3}{8}$ inch and this allows for an expansion of the gap 22 of about $\frac{1}{8}$ inch. A second bead 58 like the first bead 56 is positioned between the connecting sheet member 40 and the protective membrane 30 in the area between the second position 50 and the second side 20 of the second panel 14.

Figure 3:
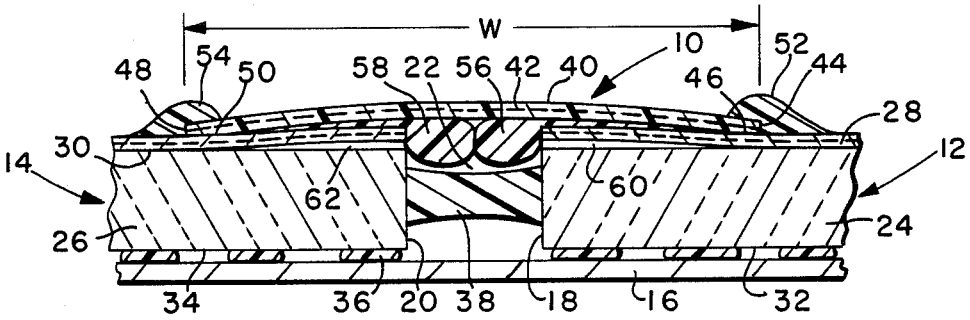
FIG. 3 is a view like FIG. 2 but showing the joint system with the panels moved apart illustrating the compensating movement of the parts of the joint system.

Referring to FIG. 3, the condition of the joint system 10 is shown after the first panel 12 and second panel 14 have been moved apart increasing the width of the gap 22 between the panels. As shown, the connecting sheet member 40 has been straightened out and the flowable material of the first bead 56 and second bead 58 has been displaced into the gap 22. Furthermore if, as shown in FIG. 3, there is additional separation of the panels 12 and 14 after the connecting sheet member 40 has been straightened out, the first and second solvent weld sealants 52 and 54 pull against the protective membranes 28 and 30 causing them to separate from the upper surface of the rigid foam layers 24 and 26 providing new expansion joint areas 60 and 62. In this way, the relative movement of the first panel 12 and second panel 14 is compensated for maintaining the integrity of the joint system 10.

Figure 4:
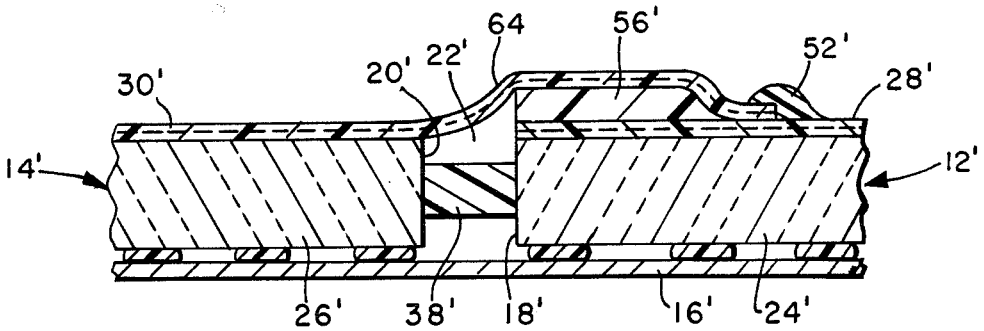
FIG. 4 is a fragmentary sectional view like FIG. 2 showing a modification of the joint system of this invention as installed.
Figure 5:
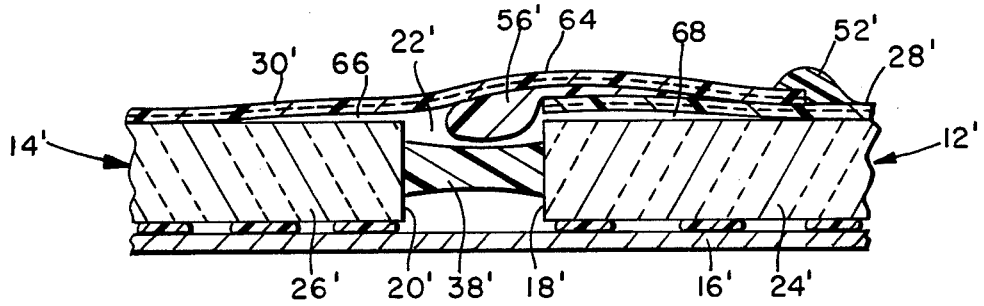
FIG. 5 is a view like FIG. 4 of the modification showing the positioning of the components with the panels moved apart.

Referring to FIG. 4, a modification is shown in which a first panel 12' is connected to a second panel 14' in a manner similar to that described hereinabove for the modification of FIGS. 1, 2 and 3. However, in this case, the second protective membrane 30' has a selvedge portion 64 which extends across the gap 22' and over the first bead 56' where it is fastened to the first protective membrane 28' by a first solvent weld sealant 52'. A vapor barrier 38' is also connected to the sides 18' and 20' of the panels 12' and 14'. Referring to FIG. 5, the condition of the modified joint with the panels 12' and 14' moved apart is shown. It can be seen that the bead 56' has been displaced into the gap 22' and the selvedge portion 64 of the protective membrane 30' has been straightened out. Also the separation of the panels 12' and 14' has been sufficient to pull the protective membrane 30' away from the foam layer 26' providing a new expansion joint area 66. Likewise the first solvent weld sealant 52' has pulled the protective membrane 28' away from the first rigid foam layer 24' providing a new expansion joint area 68. The manufacture of this modification is described in a copending patent application Ser. No. 425,841 which has been filed concurrently with this application.

With the foregoing disclosure in mind, many and varied obvious modifications of this invention will become readily apparent to those of ordinary skill in the art.

I claim:

1. A joint system for connecting a first panel to a second panel in side-by-side relationship with a first side of said first panel being spaced from a second side of said second panel defining a gap therebetween, said joint system comprising a connecting sheet member extending across said gap and fastened to an outside surface of said first panel and to an outside surface of said second panel, said connecting sheet being formed of a reinforced elastomeric material, having a length and width substantially in excess of its thickness, being free of substantial projections, and terminating in an edge at a first position spaced from said first side with a solvent weld sealant being disposed along said edge to cover said edge and adhere said connecting sheet member to said first panel to provide space for a first bead of flowable material interposed between said connecting sheet member and the outside surface of said first panel adjacent said first side so that upon movement of said first side away from said second side said connecting sheet member will be straightened out and displace said flowable material of said bead into said gap to compensate for increases in gap width due to movement of said panels apart and irregular positioning of said first panel relative to said second panel.

2. A joint system for connecting a first panel to a second panel in side-by-side relationship with a first side of said first panel being spaced from a second side of said second panel defining a gap therebetween, said joint system comprising: a connecting sheet member extending across said gap and fastened to an outside surface of said first panel and to an outside surface of said second panel, said connecting sheet having a length and width substantially in excess of its thickness, being free of substantial projections, terminating in an edge, and being connected to said first panel;

and a solvent weld sealant disposed along said edge to cover said edge and adhere said sheet member to said first panel at a first position spaced from said first side to provide space for a first bead of flowable material interposed between said sheet member and the outside surface of said first panel adjacent said first side so that upon movement of said first side away from said second side said sheet member will be straightened out and displace said flowable material of said bead into said gap to compensate for increases in gap width due to movement of said panels apart and irregular positioning of said first panel relative to said second panel.

3. The joint system according to claim 2 wherein said connecting sheet member is of a reinforced elastomeric material.

4. The joint system according to claim 2 wherein said second panel has a protective membrane at said outside surface and said membrane is a continuation of said connecting sheet member extending across said gap to said first panel.

5. The joint system according to claim 2 wherein said connecting sheet is connected to said second sheet at a second position spaced from said second side to provide space on said outside surface for a second bead of flowable material interposed between said sheet member and said second panel adjacent said second side to displace said flowable material of said second side into said gap when said sheet member is straightened out.

6. The joint system according to claim 2 wherein said bead is canted from a zero thickness at said first position to a predetermined thickness at said first side to provide for expansion of said gap.

7. The joint system according to claim 2 wherein a vapor barrier seal of elastomeric material is disposed in said gap and is adhered to said first side and to said second side.

8. The joint system according to claim 4 wherein said first panel has a protective membrane on said outside surface and said connecting sheet member is adhered to said protective membrane.

9. The joint system according to claim 2 wherein said first bead of flowable material is of hot melt sealant extruded on said space between said first position and said first side.

* * * * *